United States Patent [19]

Clarke

[11] 4,206,801

[45] Jun. 10, 1980

[54] SAND-SEAL FOR ROTARY ACOUSTIC SAND-CORE SHAKEOUT

[75] Inventor: David R. Clarke, Bloomington, Ind.

[73] Assignee: General Motors Corporation, Detroit, Mich.

[21] Appl. No.: 14,485

[22] Filed: Feb. 23, 1979

[51] Int. Cl.[2] ..... B22D 29/00

[52] U.S. Cl. ..... 164/401; 164/345

[58] Field of Search ..... 164/401, 402, 403, 404, 164/344, 345, 131, 132; 209/3, 393, 420, 421, 260; 52/65, 236.2, 144, 145; 181/200, 202, 224; 241/275, 285 R

[56] References Cited

U.S. PATENT DOCUMENTS 3,486,938 12/1969 Dubitsky ..... 164/131

FOREIGN PATENT DOCUMENTS 988708 of 1951 France ..... 164/344

*Primary Examiner*—Robert D. Baldwin
*Assistant Examiner*—K. Y. Lin
*Attorney, Agent, or Firm*—Lwarence B. Plant

[57] ABSTRACT

A sound-sealing sand trap for rotary acoustic sand-core shakeouts including bottom-opening, sand-funneling chutes beneath each decoring station and an open-centered tray beneath the sand-funneling chutes. The tray includes a sand-supporting shelf bound on its outer periphery by a sand-level-retaining rim, and on its inner periphery, and edge defining the central opening. Debris entering the tray from the chutes is readily removable through the central opening either manually by the operator or automatically by the plowing action of the chutes through the sand bed.

1 Claim, 6 Drawing Figures

SAND-SEAL FOR ROTARY ACOUSTIC SAND-CORE SHAKEOUT

BACKGROUND OF THE INVENTION

This invention relates to foundry apparatus and more particularly to apparatus for shaking sand-cores out of metal castings. More particularly, this invention is an improvement on the Rotary Acoustic Sand-Core Shakeout which is the subject of United States patent application U.S. Ser. No. 009,308, filed Feb. 5, 1979 in the name of Kenneth J. Pol and assigned to the assignee of the present invention (i.e., hereafter Pol-type).

Cores are typically removed by imparting sufficient vibration to the casting to disintegrate the core and shake the loose sand from the internal intricacies of the casting. Chipping hammers, or the like, have been particularly effective for this purpose, and involves nothing more than clamping the casting to the tool end of the hammer and rapidly striking the other end of the tool with a reciprocating piston-like hammer. One of the disadvantages of using such tools, however, is the noise that it generates. Accordingly, a variety of sound enclosures have been developed for reducing this noise during the shaking out operation and the aforesaid Pol-type is directed to one such enclosure. According to Pol-type arrangements, a plurality of work stations are spaced apart around the circumference of a turntable and encased within an acoustical enclosure which is adapted to rotate with the turntable. Each work station includes an appropriate clamp for holding the casting in place and a percussive or impact-type tool (e.g., chipping hammer) for shaking out the core sand. The rotatable enclosure includes sound absorbing partitions separating the several stations one from the other, but provides an access opening for each station facing outwardly of the turntable for loading and unloading castings. A stationary acoustical enclosure surrounds the rotatable enclosure and is in sliding sound-sealing engagement therewith at all major joints between them to contain the sound generated as much as possible to each station. The stationary enclosure has an access port at the operator's station for loading and unloading castings when it is aligned with the access opening of each station. A sand trap is provided beneath the stations for collecting falling sand and sealing off the undersides of the stations against sound emanations therefrom.

It is an object of the present invention to improve the sand trap system of Pol-type apparatus so that it can continuously automatically purge itself of debris entering the system from the decoring hammers or at least permit ready access to the system for manual removal of such debris. This and other objects and advantages of the present invention will become more readily apparent from the description thereof which follows.

BRIEF DESCRIPTION OF THE INVENTION

The present invention improves the sound-sealing sand trap of Pol-type apparatus by providing an open-centered tray beneath the sand-funneling chutes of the several decoring stations. The tray includes a substantially horizontal sand-supporting shelf immediately beneath the chutes which is wide enough to support a sand bed high enough to engage and seal off the discharge openings at the bottoms of the chutes. The outer periphery of the tray is defined by an upstanding rim which extends above the tray sufficiently to maintain the desired height of the sand bed and prevent sand spillage over the rim. The inner edge of the shelf is located sufficiently inboard of the chute openings to maintain the required sand-sealing height of the sand bed and define the central opening in the tray. Debris (e.g., broken runners) entering the sand bed from the chutes is readily removable through the central opening either manually by the operator or automatically by the plowing action of the chutes through the sand bed.

DETAILED DESCRIPTION OF THE INVENTION

The invention may be better understood in conjunction with the following detailed description made in conjunction with the several drawings in which:

FIG. 1 is a partially sectioned, side elevational view along the diameter of the turntable of an eight station shakeout apparatus constructed according to Kenneth J. Pol's concept as embodied in U.S. Ser. No. 009,308, filed Feb. 5, 1979.

Figure 1:
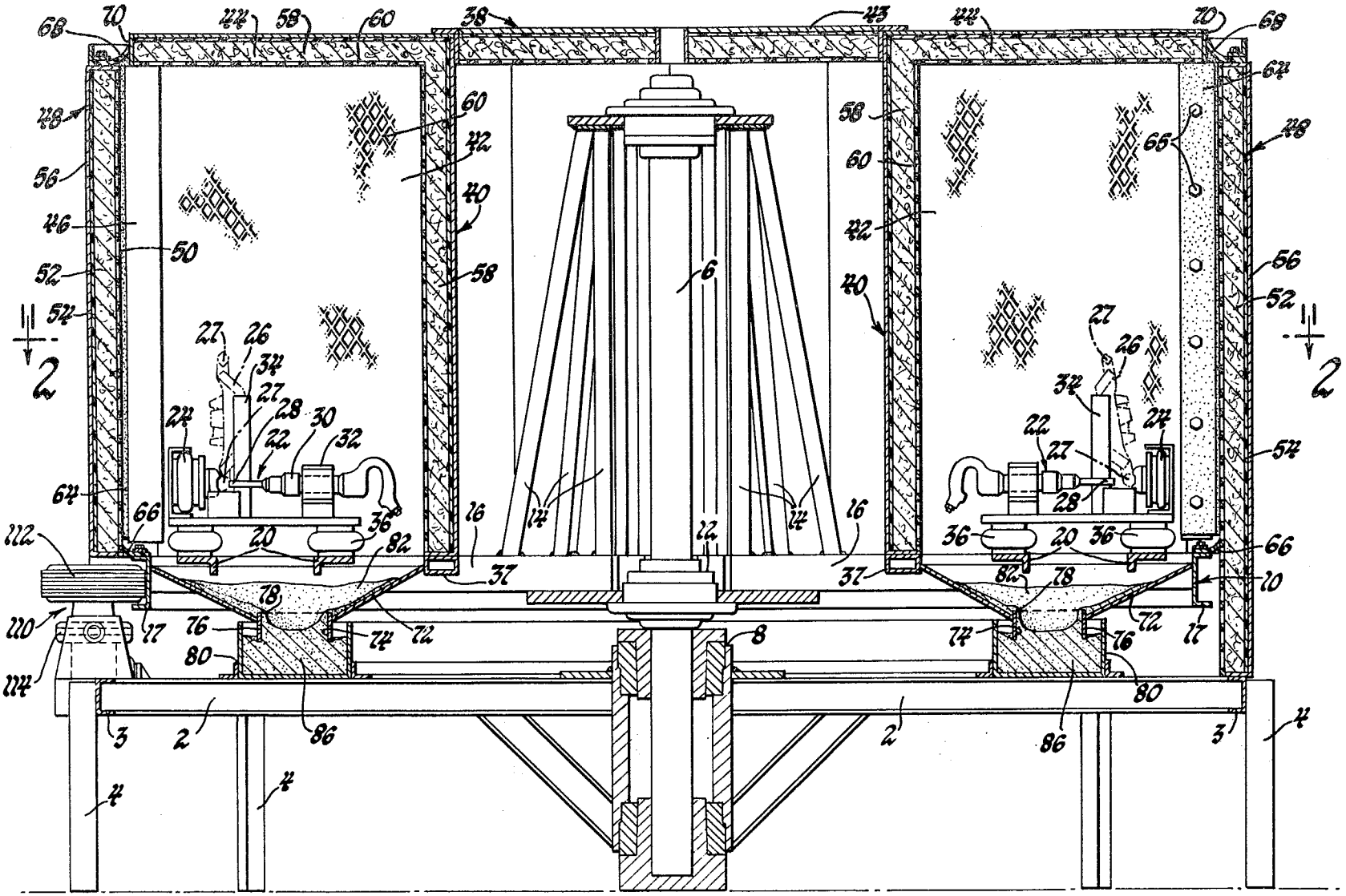

The present invention involves Pol-type shakeouts described hereafter in conjunction with the several figures. Preferred such shakeouts have an open, supporting substructure including a plurality of radially extending girders 2 joined at the ends by a channel 3 and held above the floor by legs 4. A center shaft 6 is fixedly held to the support in an appropriate pedestal 8. A turntable 10 rotates about the shaft 6 on bearings 12. Struts 14 reinforce the center of the turntable 10 and distribute its load between the bearings 12. The turntable 10 itself comprises a number of radially extending girders 16 encompassed by and welded to a channel 17 at the periphery thereof. Cross members 20 support the shakeout or decoring means 22 between the girders 16 at each station and permit the sand from the castings 26 to fall freely therebetween into the sand-seal trap beneath. This trap will be discussed in more detail hereinafter as well as the improvement thereto which is the subject of this invention.

Each work station includes a shakeout or decoring means 22 which itself comprises an air bag or bladder-type clamp 24 for clamping the casting 26 [shown in phantom in the unclamped (right) and clamped (left) positions]against the tool head 28 of a pneumatic chipping hammer 30 held in place by bracket 32. A vertical rest 34 permits quick accurate placement of the casting in the clamping fixture 24 by simply leaning the casting 26 backwards between the air bag clamp 24 and the tool head 28 as illustrated in the station on the right side of FIG. 1. The casting 26 here illustrated is shown with the casting runners 27 still attached. Upon actuation of the clamp 24, the lower runner 27 is forced into engagement with the tool head 28 as illustrated in the station on the left side of FIG. 1 and is held in this position during decoring. Elastomeric shock absorbing cushions 35 support the shakeout means 22 on the cross members 20.

An acoustical enclosure 38 for absorbing the sound generated by each shakeout means 22 is carried by the turntable 10 and adapted to rotate therewith. The rotatable acoustical enclosure 38 includes a back wall 40 supported by the turntable cross members 37, side walls or partitions 42 supported by the girders 16, and a top 44 integral with the back 40 and side walls 42. A removable sound absorbing cover 34 closes off the center of the apparatus. An outwardly facing access opening 46 is provided for loading and unloading castings 26. A stationary acoustical enclosure 48 encircles the rotary enclosure 38 and is secured to the channel 3 which joins the ends of the girders 2 together. An access port 88 (see FIG. 2) is provided in the stationary enclosure 48 through which the operator can load and unload castings 26 when the access openings 46 to each of the stations registers therewith.

Any acceptable sound-absorbing material is useful with the acoustical enclosures 38 and 48. Preferably, the stationary acoustical enclosures are a laminate of several sound-absorbing materials. The stationary enclosure, for example, preferably includes a perforated metal sheet 50 (i.e., about ⅛" thick) on the inside followed by about four inches of fiberglass insulation 52 (i.e., vinyl covered Owens Corning Type 703) and finally a thin layer 54 (i.e., about ⅛" thick) of a lead-filled, sound-absorbing sheet material (i.e., Goodyear Acousta Sheet #200) glued to a steel shell 56 (i.e., about ⅛" thick). Similarly, the rotatable enclosure 38 is preferably formed from about three inches of fiberglass 58 (i.e., Type 703), ⅛ sheets 59 of Acousta Sheet #200 and held in place by an expanded metal grid work 60. Sheet metal panels 62 between the layers of sound-absorbing material in the walls/partitions 42 provide structural support for the walls 42 and top 44.

To prevent noise leakage around the periphery of the access openings 46, the distal ends 41 of the partitions 42 are provided with elastomeric flaps 64 appropriately affixed (i.e., as by sheet metal screws 65) to the trailing sides thereof so as to flex and seal against the perforated steel inner liner 50 of the stationary enclosure 48. Similarly, elastomeric sound-sealing flaps 66 and 68 are affixed to the channel 16 and top of enclosure 48, respectively as shown in FIG. 1. In the particular embodiment illustrated, the upper annular seal 68 rides against the outer peripheral surface 70 of the rotary enclosure top 44. It is to be appreciated, however, that the acoustical top could just as well be integral with the stationary enclosure like a stationary hood. Under that circumstance, the sealing flaps would be affixed to the upper edges of the partitions 42 in much the same way as they are affixed to the distal ends 41.

Figure 2:
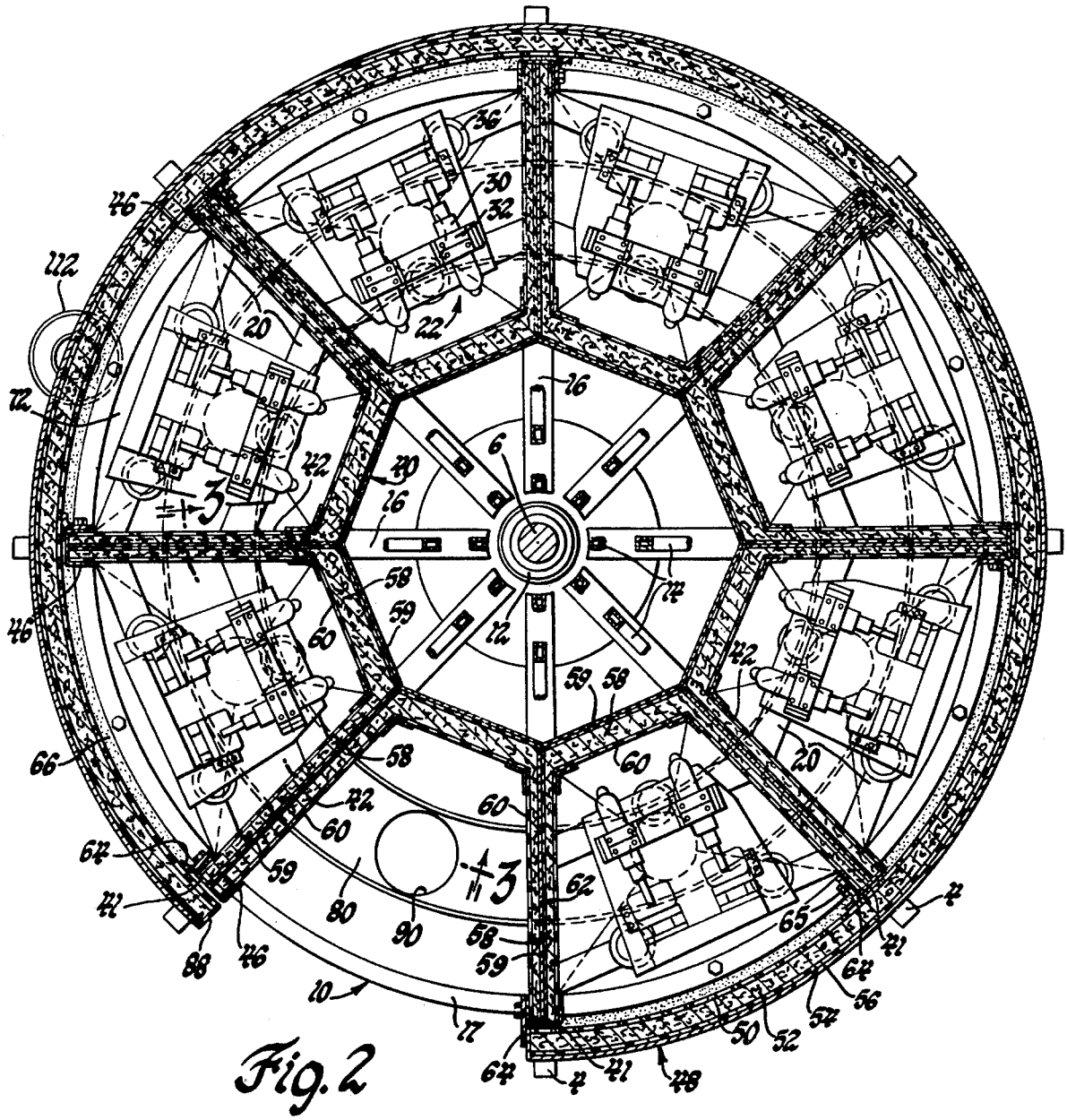
FIG. 2 is essentially a sectioned, plan view of the direction 2—2 of FIG. 1 (the shakeout means and supports therefor have been removed from the load/unload station).

A sand and sound trap is provided beneath each station 22 and includes a downwardly sloping chute 72 having an opening 74 at the bottom thereof. In the particular embodiment shown, the opening 74 is at the bottom of a tubular downcomer 76. The upper end of the downcomer 76 extends somewhat above the bottom edge of the chute 72 to form a slight dam 78 and cause the sand 82 to backup on the surface of the chute 72. Sand falling from the castings 26 is channeled to the opening 74 by the chute 72 for ultimate discharge into an annular trough 80 which tracks the path of the openings 74 in their circuit around the shaft 6. Trough 80 is filled with a bed of sand 86 to a level above the opening 74 such that the downcomer 76 drags in the sand bed 86 and the sand effectively seals off opening 74. Hence, the chute 72, sand-sealed opening 74 and sand-filled trough 80 combine to attentuate any sound emanating from the underside of the stations. The trough 80 is provided with a discharge opening 90 (see FIGS. 2 and 3) located at the load/unload station at the access port 88. Here sand accumulated in the trough 80 and pushed ahead of the tube 76 as it rotates is discharged into any appropriate collector 92 for removal from the area. FIG. 2 has been drawn to delete the detail of the shakeout means 22, the supporting cross members 20 and the chute 72 so as to better show the relationship of the discharge opening 90 in trough 80 to the opening 74 in the chute 72. As the shakeout means 22 is inoperative at the loading/unloading station adjacent the access port 88, disruption of the sand-sealing of opening 74 thereat does not create a noise problem for the operator.

Figure 3:
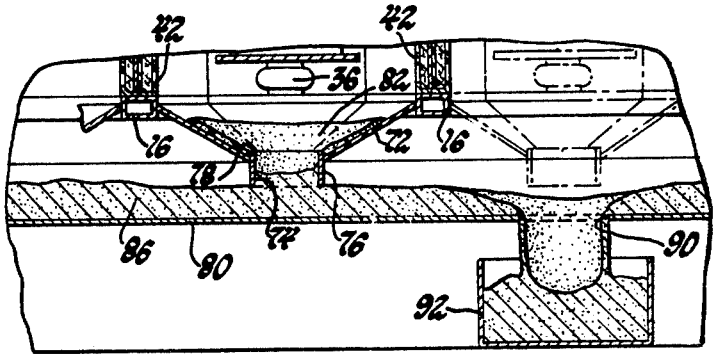
FIG. 3 is a section in the direction 3—3 of FIG. 2 and depicts the sand removal site at the load/unload station.
Figure 4:
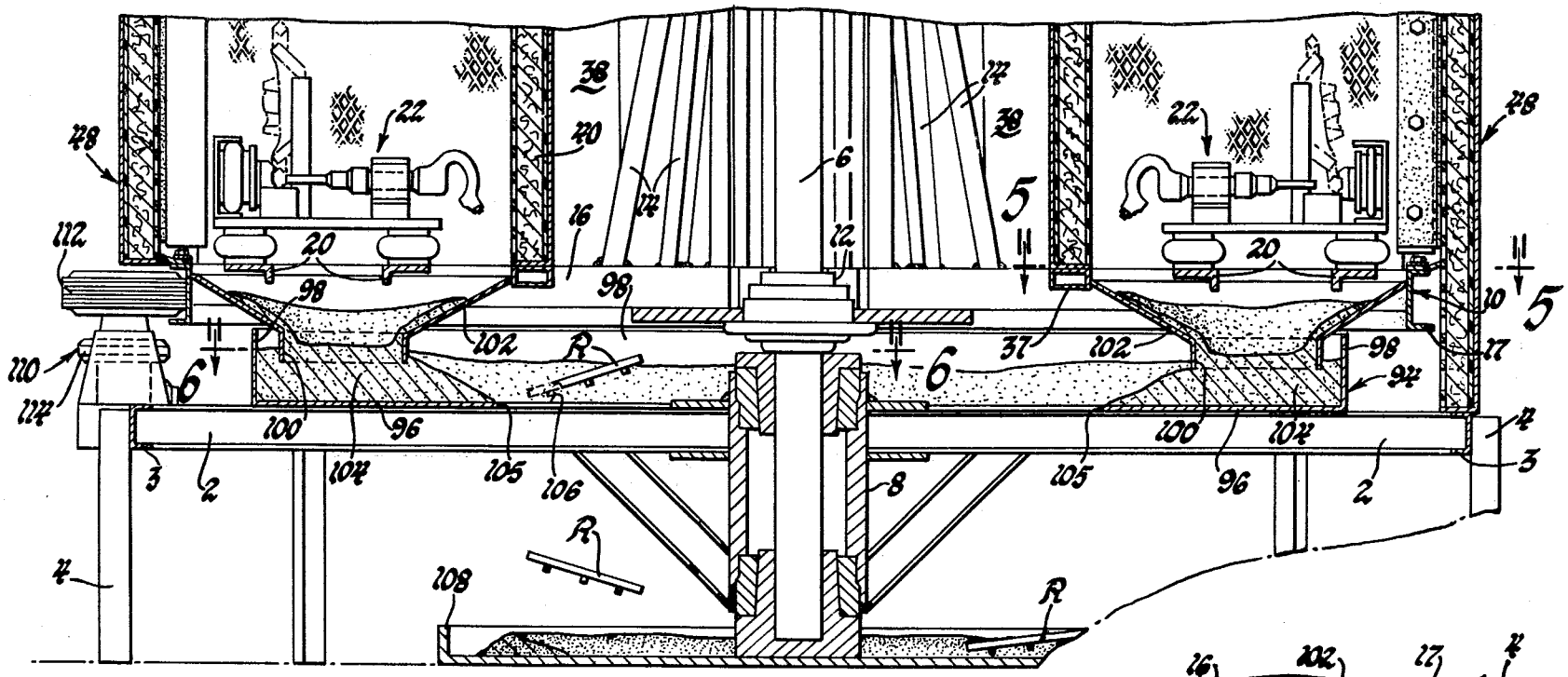
FIG. 4 is a partially sectioned, side elevational view along the diameter of an eight station Pol-type shakeout apparatus including a sand-trap according to the present invention.
Figure 5:
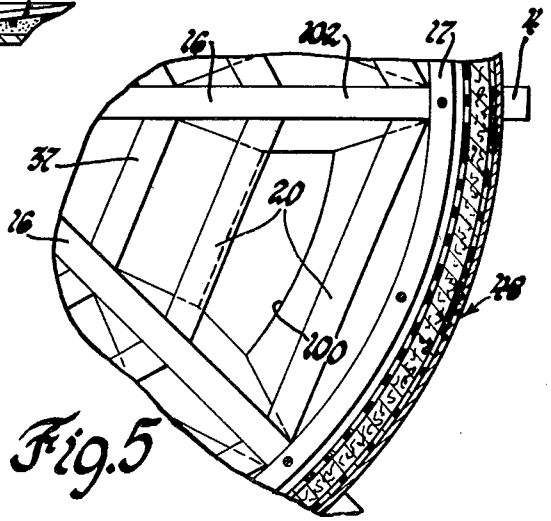
FIG. 5 is a partial sectioned view in the direction 5—5 of FIG. 4.
Figure 6:
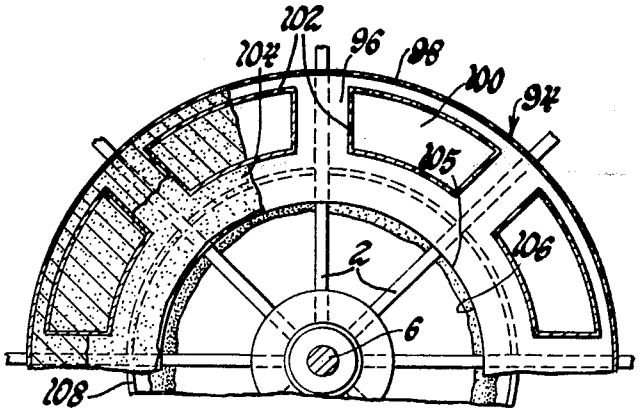
FIG. 6 is a partial sectioned view in the direction 6—6 of FIG. 4.

FIGS. 4–6 illustrate the improved sand trap of the present invention. This trap has the capability of automatically discharging any solid debris, such as broken runners R, or the like, which might fall through the chute 72 and become jammed in a trough 80. Moreover, with this design, an operator can easily and unobstructedly reach up under the work stations to manually clear them of fallen debris, if that is necessary. Hence, according to the present invention, the trough 80 of the embodiment of FIGS. 1–3 is replaced with an annular tray 94. The tray 94 has a bottom shelf portion 96 and an upstanding rim 98 outboard the openings 100. The rim extends upwardly from the shelf 96 to a level sufficient to maintain the level of the sand bed 104 in sealing-off engagement with the openings 100 and to prevent sand from flowing over the rim. Preferably, this level is above the discharge opening 100. The shelf portion 96 of the tray 94 extends from the rim 98 inwardly towards the shaft 6 such that the inside edge is sufficiently inboard of the opening 100 in the chute 102 that the bed of sand 104 beneath the chute 102 will still seal off the opening 100 without the need for an inner rim such as was required to form the trough 80 of the FIGS. 1–3 embodiment. The inner edge 105 defines a large opening 106 in the center of the tray 94. This opening 106 has been found to be extremely advantageous in reducing machine down-time. In this regard, it permits the operator to easily reach up through the opening 106 into the tray 94 for removing any debris (e.g., broken runners R or the like) that might fall into the tray 94 through the opening 100 and which would otherwise tend to become wedged and jam the apparatus if a closed-sided trough 80 were used (i.e., FIGS. 1–3). Moreover, without an inner rim, the tray 94 tends to be automatically self-cleaning in that much of the debris is actually pushed out of the sand bed 104 through the opening 106 by the bottom of the chute 102 as it plows through the bed 104. A secondary tray, chute or the like 108 is provided beneath the opening 106 to collect any debris or sand which might fall through the opening 106. As with the embodiment of FIGS. 1–3, sand is removed from the tray 94 principally through a discharge opening (i.e., like 90 of FIG. 1) in the shelf 96 at the operator's station. The elongated opening 100 (see FIG. 5) in the chute 102 more readily passes broken runners and other debris than does the smaller opening 90 illustrated in FIG. 1.

The turntable 10 and rotatable, acoustical enclosure 38 are driven about the shaft 6 by pneumatically actuated friction drive means 110 which comprises essentially a rubber wheel 112 and a speed reduced motor 114. Electric or other drives may readily be substituted. Drive means 110 is enclosed in its own removable acoustical housing (not shown) to further contain the noise within the stationary enclosure 48.

In operation, a single operator is positioned at the access port 88 in the stationary enclosure 48. By means of manually depressible buttons (i.e., one for each hand) adjacent to, but clear of, the access port 88, the operator causes the turntable to index ⅛ turn (i.e., for an eight station unit) to sequentially register the access openings 46 in the rotatable enclosure 38 with the access port 88 in the stationary enclosure 48. He then removes the decored casting 26, replaces it with a core-filled casting 26, and indexes the turntable again. As the newly loaded shakeout means 22 leaves the access port 88 and moves within the stationary enclosure 48, a limit switch (not shown) is tripped to commence the shakeout operation. Shakeout may continue for the entire time the station 22 is in transit from the access port 88 and back again but is normally controlled by a timer (not shown) triggered by the starting limit switch to keep the actual decoring operation to a minimum. Regardless, a second limit switch (not shown) is provided on the turntable 10 to insure that, whether timed or not, the shakeout operation is discontinued just prior to the decoring station's entering the operator's station at the access port 88. Hence, all decoring is performed within the stationary enclosure 48 and the bulk of the noise generated is confined therein. Lastly, appropriate safety switches are provided at the access port 88 to stop or brake the turntable 10 and enclosure 38 in the event an operator's limb or obstacle remain in the access port while the enclosure 38 is rotating.

While the invention has been disclosed primarily in terms of a specific embodiment thereof, it is to be understood that other variations thereof are possible within the scope of Applicant's invention. Hence, this invention is limited not to the specific embodiment disclosed, but rather, only to the extent set forth in the claims which follow.

The embodiments of the invention in which an exclusive property or privilege is claimed are defined as follows:

1. In a shakeout apparatus for removing sand-cores from metal castings of the type comprising essentially a turntable bearing a plurality of discrete percussive decoring stations circumferentially spaced thereon, a rotatable acoustical enclosure mounted on the turntable for rotation within a stationary acoustical enclosure, a bottom-opening, sand-collecting chute depending from said turntable beneath each of said stations, and a receptable beneath the openings in said chutes for receiving sand from said openings and maintaining a bed of said sand therein at a level sufficient to engage and acoustically seal off said openings during rotation and decoring, the improvement comprising:

said receptacle comprising a tray including a sand-supporting shelf having an inner edge defining a substantially central opening in said tray and an upstanding rim on its outer periphery, said rim being located outboard said chute openings and extending sufficiently above said shelf to maintain said sand level thereon while preventing sand spillage over said rim during said rotation, and said inner edge being located sufficiently inboard said chute openings as to maintain said sand level yet permit ready removal through said central opening of such debris as might enter said bed from said chute openings.

* * * * *